US011020684B2

(12) United States Patent
Peeples

(10) Patent No.: US 11,020,684 B2
(45) Date of Patent: Jun. 1, 2021

(54) HAZE-FILLED BUBBLE DEVICE AND METHOD FOR PRODUCING HAZE-FILLED BUBBLES

(71) Applicant: CHAUVET & SONS LLC, Sunrise, FL (US)

(72) Inventor: Rick B. Peeples, Richmond Hill, GA (US)

(73) Assignee: Chauvet & Sons, LLC, Sunrise, FL (US)

( * ) Notice: Subject to any disclaimer, the term of this patent is extended or adjusted under 35 U.S.C. 154(b) by 55 days.

(21) Appl. No.: 16/448,830

(22) Filed: Jun. 21, 2019

(65) Prior Publication Data

US 2020/0398177 A1 Dec. 24, 2020

(51) Int. Cl.
*A63H 33/28* (2006.01)
*A63J 5/02* (2006.01)

(52) U.S. Cl.
CPC ..... *A63H 33/28* (2013.01); *A63J 5/025* (2013.01)

(58) Field of Classification Search
CPC ..... A63H 33/28; A63J 5/025; A63J 2005/007; A63J 5/00
USPC ..... 446/15, 16, 18, 20, 21
See application file for complete search history.

(56) References Cited

U.S. PATENT DOCUMENTS

| | | | | |
|---|---|---|---|---|
| 5,879,218 A * | 3/1999 | Tao | A63H 33/28 446/15 |
| 6,241,571 B1 * | 6/2001 | Chow | A63H 33/28 446/16 |
| 2005/0148276 A1 * | 7/2005 | LaFata | A63H 31/08 446/18 |
| 2006/0116048 A1 * | 6/2006 | Choi | A63H 33/28 446/15 |
| 2009/0017713 A1 * | 1/2009 | Chung | A63H 33/28 446/15 |
| 2018/0272245 A1 * | 9/2018 | Pogue | A63H 33/28 |

* cited by examiner

*Primary Examiner* — Nini F Legesse
(74) *Attorney, Agent, or Firm* — Laurence A. Greenberg; Werner H. Stemer; Ralph E. Locher

(57) ABSTRACT

A haze-filled bubble device and method for producing haze-filled bubbles are provided that encapsulates a haze inside a rapidly emitted, continuous flow of bubbles, without permitting significant amounts of the haze to escape the device outside of the bubbles. Bubble solution is pumped into a bubble wand and a wiper cycles across its face to form a meniscus of bubble solution over the bubble wand's outer face. Additionally, a haze generating assembly can selectively pump fog fluid to a heater and a resultantly generated haze is provided to an enclosed chamber. A fan in the enclosed chamber forces the haze from the chamber into a conduit that channels the haze into the bubble wand and to the miniscus, where the air flow created by the fan is used to form haze-filled bubbles.

21 Claims, 5 Drawing Sheets

HAZE-FILLED BUBBLE DEVICE AND METHOD FOR PRODUCING HAZE-FILLED BUBBLES

BACKGROUND OF THE INVENTION

1. Field of the Invention

The present invention relates to a device and method for producing haze or fog which is encapsulated in bubbles before being released by the device for use in producing entertainment effects.

2. Description of the Related Art

Fog-filled bubble devices are known in the art. For example, U. S. Patent Application Publication No. 2018/0272245 to Pogue et al ("Pogue"), incorporated herein by reference in its entirety, discloses a bubble, fog, haze and fog-filled bubble device. The Pogue reference will be discussed more particularly in connection with FIGS. 1A and 1B of the present application. A bubble, fog, haze and fog-filled bubble device 10 of Pogue discloses, among other things, a front portal 20, behind which is a bubble reservoir 30 to coat a plurality of bubble wands 40 that pass through a bubble fluid reservoir 30. See, for example, paragraph [0014] of Pogue. Once coated, air from a fan 50 can blow bubbles from the wands 40 so the bubbles can exit from the front portal 20. According to paragraph [0015] of Pogue, fog is generated from fog fluid that is flash vaporized and then expelled via a heater core nozzle 60 to a fog outlet. The fog is moved by the fan 50 into the bubbles created from the bubble wands 40, thus creating fog-filled bubbles or bubble-fog. One consequence of this design, however, is that since the front portal 20 is open, fog moved by the fan 50 towards the front portal 20 not only goes through the bubble wands 40 and into the bubbles formed thereby, but also past the bubble wands 40 and out the front portal 20. Thus, the bubble, fog, haze and fog-filled bubble device 10 spits out from its front portal 20 fog-filled bubbles, as well substantial amounts of fog outside and around the bubbles.

There is a need in the art for a new and improved bubble device and method where substantially all, if not all, of the fog or haze exiting the device is encapsulated inside the bubbles, and not outside and around the bubbles.

U. S. Patent Application Publication No. 2009/0017713 to Chung ("Chung") discloses a smoke-filling-bubble generator having at least one blower and a nozzle assembly that includes a swaying arm and a nozzle mounted on the swaying arm. The swaying arm controllably dips the nozzle into suds contained in a cup and inserts the nozzle into an outlet from which the smoke is blown. With the smoke gradually blown out of the outlet, bubbles containing smoke are individually formed in the nozzle and fly into the air. See, for example, the Abstract of Chung. Referring now to FIG. 2, herein, there is shown a side view in partial section of a smoke-filling-bubble generator 70, as taught in Chung. In Chung, a nozzle assembly 80 is mounted in the mechanism compartment 72 of a casing 74, and comprises a swaying arm 82, a nozzle 84, a gear assembly 86 and a controlling motor 88. See, for example, paragraph [0031] of Chung. The controlling motor 88 controllably rotates the first gear via a belt, and actuates the swaying arm 80 to regularly pivot between a first position (shown in dotted line) and a second position (shown in solid line) through the second gear. In the first position, the nozzle 84 dips in the suds in the cup 75, as illustrated in FIG. 2. In the second position, the nozzle 84 pushes a resilient valve 76 away from an outlet 78 and is inserted into, and communicates with the outlet 78 of the casing 74. A blower 90 is mounted in a smoke chamber 92 of the casing 74 and generates airflow to blow smoke through the outlet 78 and forms smoke-filling bubbles on the nozzle 84 when the nozzle 84 is at the second position. One problem with the smoke-filling-bubble generator of Chung is that, when in the first position, i.e., while the nozzle 84 is dipped in the cup 75, bubbles are not being blown by the device of Chung. Rather, the outlet 78 is sealed by the valve 76 until such a time as the nozzle 84 swings back to the second position, and pushes the valve 76 away from the outlet 78. Thus, there are gaps in the stream of bubbles emitted, based on the requirement to dip the nozzle 84. Additionally, moving the nozzle 84 to the cup 74 to apply the bubble fluid to the nozzle 84, and then back to the second position with the nozzle 84 in communication with the outlet 78 requires a complex mechanism of moving parts, including a large swaying arm driven by an electric motor and a series of belts and bearings, each of which contributes additional cost and possible failure points, and all of which collectively make the housing 102 larger and heavier.

What is needed is a smoke or haze-filled bubble device that does not need to stop blowing bubbles to periodically dip the nozzle into the bubble solution, and thus, can more quickly emit a continuous stream of bubbles. What is further needed is a smoke or haze-filled bubble device with a simplified method of applying bubble fluid to the bubble forming nozzle that does not require movement of the bubble nozzle to apply bubble fluid to the nozzle, thereby reducing cost, size, weight and possible failure points.

BRIEF SUMMARY OF THE INVENTION

The present invention is particularly suited to overcome those problems that remain in the art in a manner not previously known or contemplated. It is accordingly an object of the invention to provide a haze-filled bubble device and method for producing haze-filled bubbles that encapsulates the haze inside a rapidly emitted, continuous flow of bubbles, without permitting significant amounts of the haze to escape the device outside of the bubbles. In one particular embodiment of the invention, bubble fluid or solution is pumped into a bubble wand and a wiper cycles across its face to form a meniscus of bubble solution over the bubble wand's outer face. In one particular embodiment, a haze generating assembly selectively pumps fog fluid to a heater and a resultantly generated haze is provided to an enclosed chamber. A fan in the enclosed chamber forces the haze from the chamber into a conduit that channels the haze into the bubble wand and to the miniscus, where the air flow created by the fan is used to form haze-filled bubbles.

Although the invention is illustrated and described herein as embodied in a haze-filled bubble device and method for producing haze-filled bubbles, it is nevertheless not intended to be limited to moving head light fixtures or the details shown, since it may be used with other types of light fixtures and various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings in which like reference numerals indicate like parts throughout the several views thereof.

DETAILED DESCRIPTION OF THE INVENTION

It is accordingly an object of the invention to provide a haze-filled bubble device and method for producing haze-filled bubbles. For purposes of the present description, the terms "haze", "fog" and "smoke" are meant to be used interchangeably herein to mean an opaque vapor. The terms "fluid" and "solution" are additionally used interchangeably, herein, when referring to the liquids used to generate haze and bubbles. Additionally, the drawings have been simplified for clarity and may include additional elements not shown. For example, it is understood that various electrical connectors, components and lines are present, but not illustrated, in order to provide control signals and power for operating the various motors, switches, pumps, heater and controller (which includes a processing device, such as a microprocessor).

Figure 1A:
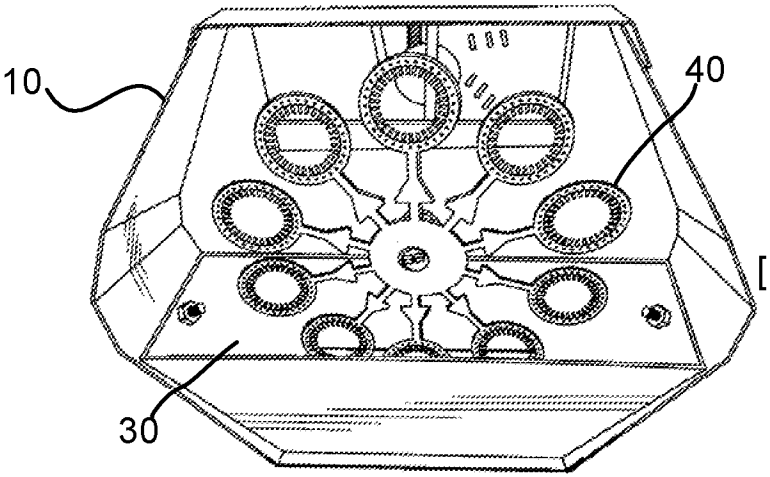
FIG. 1A [PRIOR ART]
FIG. 1A is a front perspective view of a bubble, fog, haze and fog-filled bubble device in accordance with the prior art.
Figure 1B:
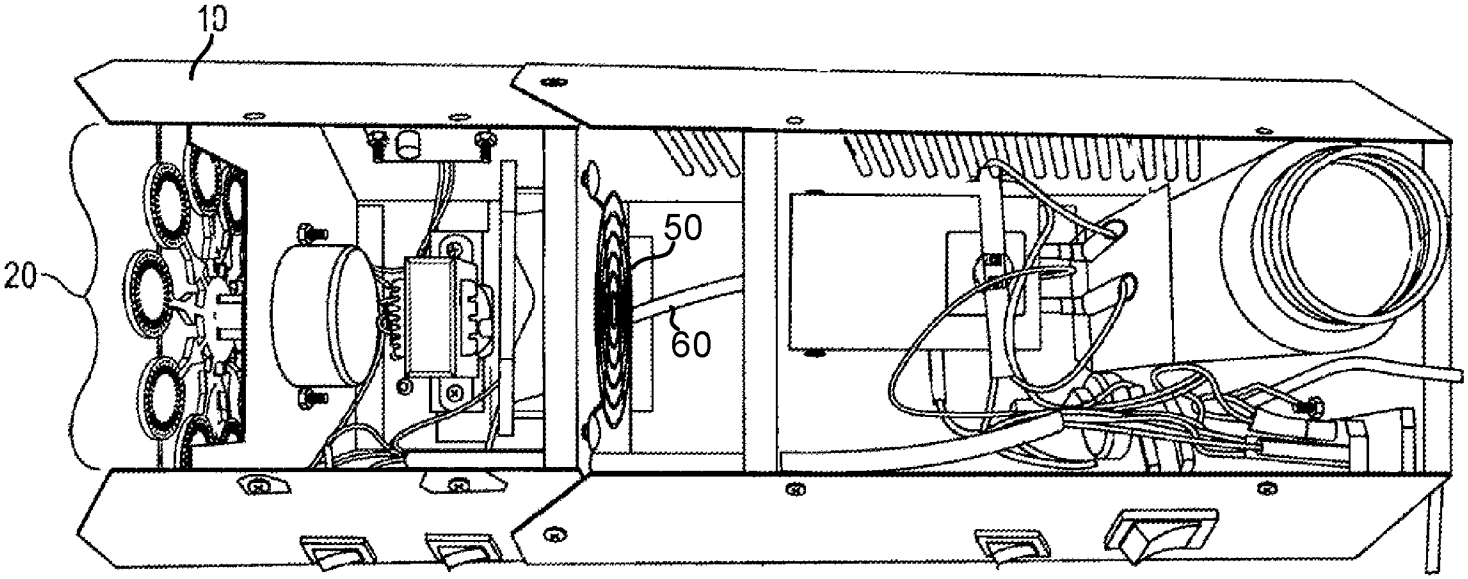
FIG. 1B [PRIOR ART]
FIG. 1B is a top, partial cut-away view of a bubble, fog, haze and fog-filled bubble device in accordance with the prior art.
Figure 2:
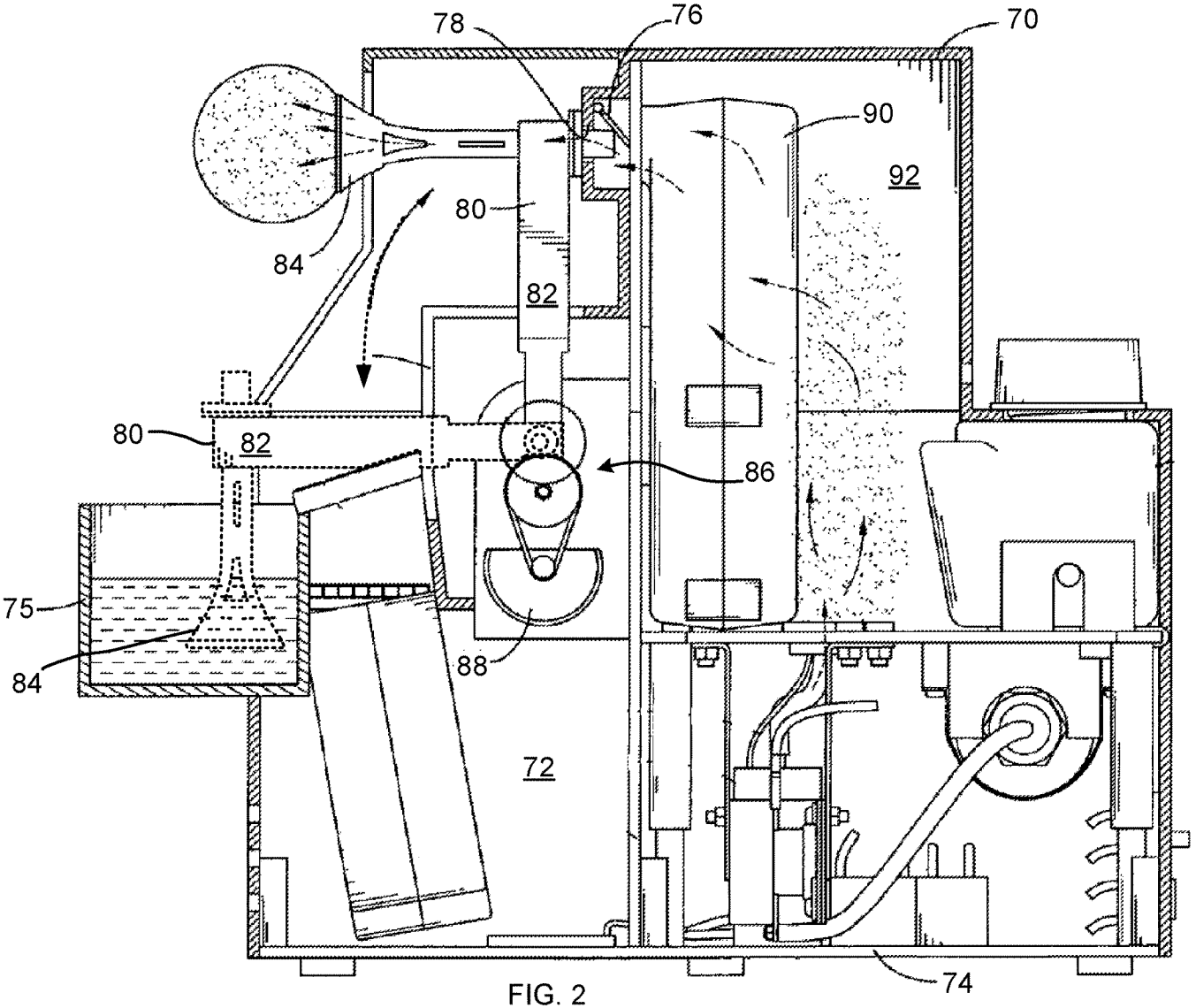
FIG. 2 [PRIOR ART]
FIG. 2 is a side view in partial section of a smoke-filling-bubble generator in accordance with the prior art.
Figure 3:
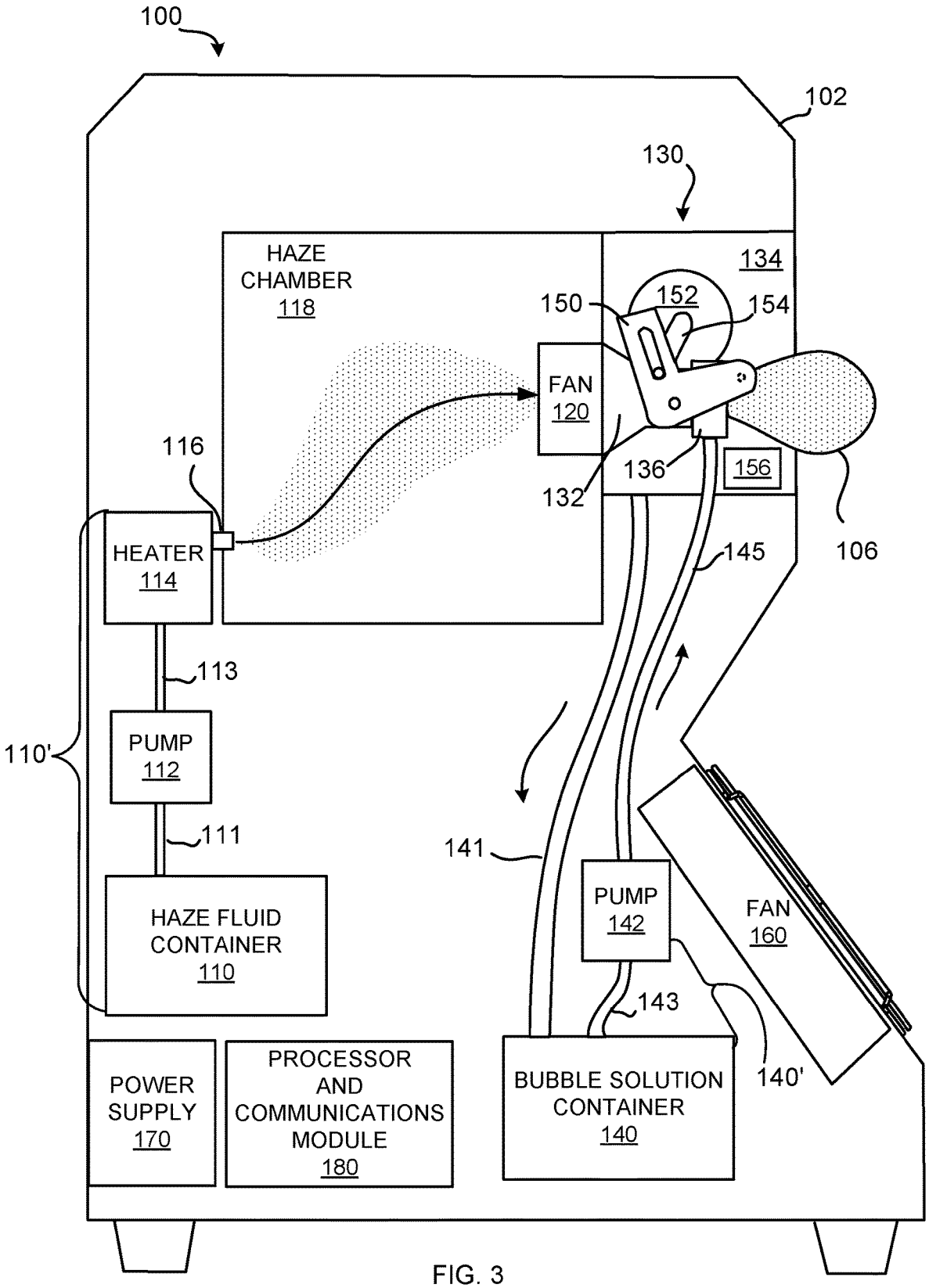
FIG. 3 is a simplified block diagram of a haze-filled bubble device in accordance with one particular embodiment of the invention.
Figure 4:
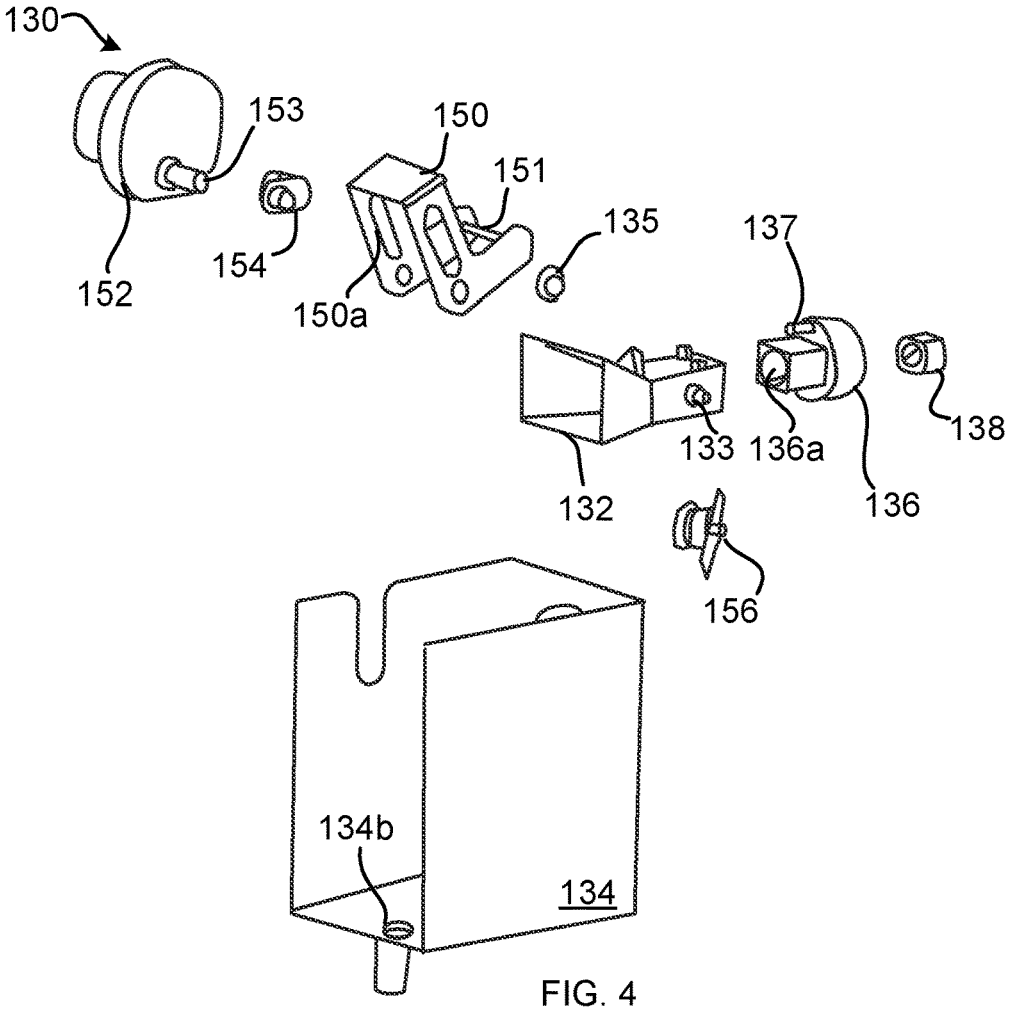
FIG. 4 is a rear perspective, exploded view of a bubble creating assembly in accordance with one particular embodiment of the invention.
Figure 5:
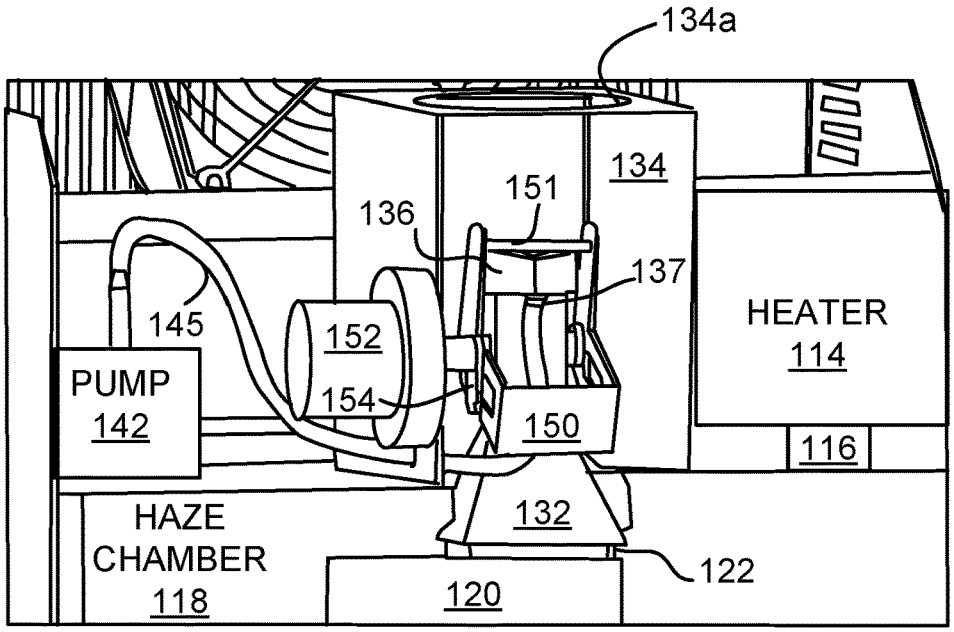
FIG. 5 is a partial perspective cut-away view, taken from the top, of a haze-filled bubble device in accordance with one particular embodiment of the invention.
Figure 6:
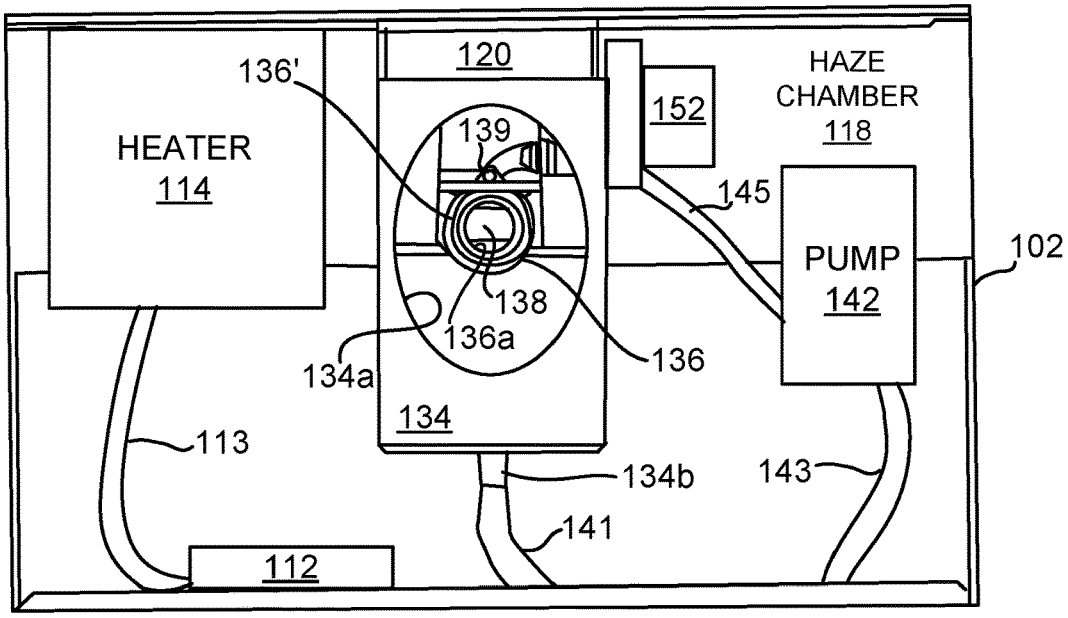
FIG. 6 is a partial perspective cut away view, taken from the front, of a haze-filled bubble device in accordance with one particular embodiment of the invention.

Referring now to FIGS. 3-6, there will be described one particular embodiment of a haze-filled bubble device 100 that operates to expel haze-filled bubbles from a housing 102. More particularly, a housing 102 includes mechanisms for making haze, bubbles and haze-filled bubbles. For example, haze is formed using a haze solution contained in the haze fluid container or reservoir 110. Such haze solutions are typically made using water and one or more of mineral oil, propylene glycol and/or glycerin. In one particularly illustrated haze source 110', haze solution is pumped from the haze solution container 110 by a pump 112 (via lines 111 and 113) to a heater assembly 114, where it is vaporized. The resultant haze exits the heater assembly 114 via a nozzle 116 that opens into an enclosed haze chamber 118, where it accumulates. A fan 120 draws the haze from the enclosed haze chamber 118 and forces it out of the enclosed haze chamber 118 and into the bubble creating assembly 130.

More particularly, in the present preferred embodiment, the fan 120 forces haze from the enclosed haze chamber 118 into a conduit 132 disposed at the output of the fan 120 in the enclosure 134. In one particularly preferred embodiment of the invention, the conduit 132 is configured as a funnel, having a progressively narrowing cross-section from its entry point to its exit point. An output duct 122 from the fan 120 is fitted into the mouth of the conduit 132 to ensure that all haze leaving the enclosed haze chamber 118 must exit through the conduit 132 of the bubble creating assembly 130. A bubble wand or bubble nozzle 136 having a central passageway 136*a*, is joined in fluid communication with the conduit 132, at the end distal from the fan 120. A center plug 138 is fitted into the distal end of the wand 136, to concentrate and/or direct the air/vapor flow out from the bubble wand 136. The bubble wand 136 is aligned with an opening 134*a* in the front of the enclosure 134, through which the bubbles formed may exit the enclosure 134. The housing 102 is additionally open in front of the opening 134*a*, so that the bubbles created at the wand 136 can exit the front face of the device 100.

Bubble solution is provided to the bubble wand 136 from a bubble solution container or reservoir 140 in the housing 102. More particularly, a pump 142 of a bubble fluid source 140' is used to pump bubble fluid from the container 140 to the wand 136, via the connected hoses 143 and 145. In one particular embodiment of the invention, the pump 142 is a peristaltic pump, although the invention is not intended to be limited only thereto, as other types of pumps may be. The hose 145 from the pump 142 passes through the enclosure 134 to connect with a tube 137 of the bubble wand 136. The tube 137 is connected to a passage that passes continuously through the bubble wand 136 and opens on the outwardly pointing front face 136' of the bubble wand 136 at the orifice 139. In operation, the pump 142 is switched on momentarily to extrude a bead of bubble fluid from the orifice 139 and onto the front face 136' of the bubble wand 136.

The bubble solution extruded from the opening 139 is then wiped over the outwardly pointing front face 136' of the bubble wand 136, by a wiping arm 150, as it is rocked (i.e., pivots) up and down (or back and forth, as desired) by a motor 152. In particular, the bar 151 is brought into close proximity with the face 136' of the bubble wand 136 and spreads the bubble fluid over the face 136' of the wand as the wiping arm 150 is rocks. The wiping arm 150 is mounted at pivot points 133 on the sides of the conduit 132 with a retaining ring 135. The motor 152 includes a shaft 153 that is engaged with a crank arm 154, which, in turn, is engaged with a cam slot 151*a* of the wiping arm 150. As the motor shaft rotates, a pin of the crank arm 154 slides within the slot 150*a*, causing the wiping arm 150 to rock back and forth about the pivot points 133, spreading the extruded bead of bubble fluid over the face 136' of the bubble wand 136 with the bar 151 to form a meniscus of bubble fluid over the bubble wand 136. Haze blown by the fan 120 through the conduit 132 causes this meniscus to form bubbles 106 that are output through the opening 134*a*, and out the front of the device 100.

Additionally, in one particular embodiment of the invention, a spring-loaded switch 156 is disposed under the wiping arm 150, such that, when the wiping arm rocks forward, it pushes an arm of the switch 156 to the closed position, causing the pump 142 to dispense a bead of bubble fluid. As the wiping arm 150 rocks back, the switch arm is released, and pumping is discontinued until the switch arm is again pushed by the rocking wiping arm 150 to the closed position. Thus, a bead of bubble fluid is extruded and wiped over the face of the bubble wand 136, cyclically, during the operation of the bubble device 100.

In one particular embodiment of the invention, excess bubble fluid extruded from the opening 139, which drips off of the bubble wand 136 and/or the bar 151, collects on the floor of the enclosure 134, which in the present embodiment includes a drain hole 134*b*. Drain hole and pipe 134*b* is connected to a tube 141, through which excess bubble fluid is returned from the enclosure 134 to the bubble solution container 140, for reuse.

Additionally, in one particular embodiment of the invention, the haze-filled bubble device 100 includes a fan 160, that is blows outward from the housing 102. In one particular embodiment, the fan 160 is disposed at an angle in the housing, so as to blow bubbles emitted from the front of the housing 102, upward and forward of the housing 102. In one particularly preferred embodiment, the fan 160 is disposed at a 45 degree angle relative to the ground, which would be parallel to the floor of the housing 102. In another particularly preferred embodiment, the fan 160 is disposed in the housing at a 30 degree angle relative to the ground or floor of the housing. Additionally, if desired, the housing 102 itself may include a cut out portion in the housing face, to ensure that air blown by the fan 160 is used to lift bubbles emitted from the front of the housing 102. In yet another particularly preferred embodiment, the fan 160 angle can be adjusted by the user to optimize the desired height and distance of the emitted bubbles. For example, if the housing 102 is positioned near the ground, a greater angle may be desired to push bubbles higher. Alternatively, if the housing 102 is positioned higher off the ground, a smaller angle may be desired to push bubbles straighter out of the housing to achieve a greater distance.

It should be understood that different functions of the haze-filled bubble device 100 can be operated independently from one another, as well as, together. For example, if desired, external switches (not shown) can be provided on the device 100 that allow the bubble making assembly 130 to operate, while the haze generating portion of the device 100 is off. The fan, in this mode, would only blow or force air through the conduit, and not haze. This would result in the generation of empty bubbles.

Similarly, the bubble making assembly 130 could be turned off while the haze making assembly is on, resulting in haze being produced from the device, without accompanying bubbles. However, it should be appreciated that, in the instant invention, when both the bubble making assembly 130 and the haze assembly are functioning together, the speed of the wiping arm and ensures that a meniscus of bubble fluid is continuously, cyclically, formed on the bubble wand 136, in order to provide a rapid stream of haze-filled bubbles, without a significant amount of haze being output outside of the bubbles. Additionally, if desired, the fan 160 could be omitted or can be configured to be turned on or off independently of the bubble making and haze making assemblies.

The haze-filled bubble device 100 of the present invention includes a power supply 170 configured to convert AC power from a power source to a power level required for operating the device. Optionally, a processor and communications module 180 is provided, which is configured to receive input control signals from external devices and convert them to instructions carried out by the device 100.

Processor and communications module 180 includes a microprocessor and non-transitory memory storing programs for operating the haze and bubble making assemblies and for receiving control signals and converting them to actions of the device 100. In one particular embodiment, the processor and communications module 180 optionally includes hardware connectors and/or a transceiver module for connecting the device 100 to an external control device for providing control signals to the device 100. For example, in one embodiment of the invention, hardware connectors (not shown) are provided through the housing 102 for receiving DMX control signals from a lighting panel or other source. In a further embodiment, the communications module 180 includes a transceiver configured to communicate with external devices via BLUETOOTH™, cellular communications or WiFi.

In one particular embodiment of the invention, the processor and communications module 180 receives control signals, such as DMX control signals, from an external source, to operate the bubble machine in coordination with an external device, such as a lighting device or sound machine.

Figure 7:
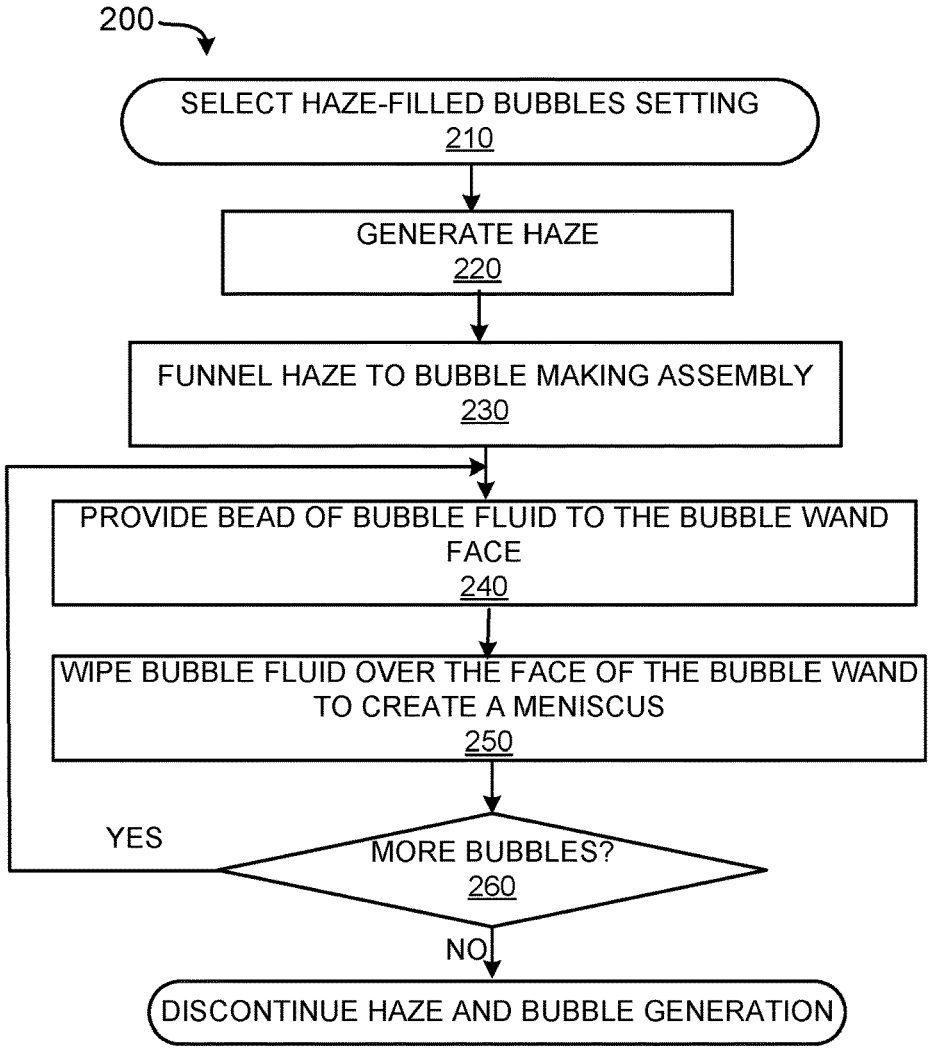
FIG. 7 is a flow diagram useful in understanding a method for making haze-filled bubbles in accordance with one particular embodiment of the invention.

Referring now to FIGS. 3-7, one particular embodiment of a method 200 for generating haze-filled bubbles using the device 100 will be described. First, the device 100 is powered and a haze-filled bubble setting is selected. In particular, a button or user interface can be provided that allows the user to select to produce empty bubbles, haze without bubbles, or haze-filled bubbles and to control a lifting fan 160. Step 210. If the haze-filled bubble setting is selected, the device 100, via a processor or a direct switch connection, as desired, is configured to start the heater 114 and pump 112 to provide haze solution from the haze container to the heater 114. Haze is generated as the fluid is vaporized by the heater 114. Step 220. The resultantly generated haze is provided to an enclosed haze chamber 118 and, from there, is forced into the conduit 132 by the fan 120, where it is provided to the bubble making assembly, and in particular, to the bubble wand 136. Step 230.

Simultaneously, if bubble-making is also selected, a small portion or bead of bubble fluid is pumped to the bubble wand 136 and output from an opening 139 on the face of the bubble wand 136. Step 240. Motor 152 operates to rock the wiper arm 150, which causes the bar 151 to wipe or spread the emitted bubble fluid over the face of the bubble wand 136 to create a meniscus. Step 250. Since haze is being continuously generated, stored in the enclosed haze chamber 118 and forced into the conduit 132, the formation of a meniscus on the face of the bubble wand 136 naturally results in the formation of haze-filled bubbles as the fan-blown haze exits through the formed meniscus. So long as it is desired for haze-filled bubbles to be formed, the bubble making assembly 130 cyclically pumps out a bead of fluid (step 240) and wipes it across the face of the bubble wand 136 (step 250) to rapidly replenish the meniscus, all while haze is being continuously generated (step 220) and forced into the conduit (step 230). Step 260. The result is a rapidly emitted, continuous flow of bubbles produced from the face of the device 100, without permitting significant amounts of the haze to escape the device 100 outside of the bubbles.

Although the invention is illustrated and described herein as embodied in a haze-filled bubble device and method for producing haze-filled bubbles, it is nevertheless not intended to be limited to the details shown, since various modifications and structural changes may be made therein without departing from the spirit of the invention and within the scope and range of equivalents of the claims.

I claim:

1. A haze-filled bubble device, comprising:

a haze source;

a bubble fluid source;

an enclosed haze chamber including an inlet nozzle in fluid communication with said haze source said inlet nozzle arranged to pass haze from said haze source into said enclosed haze chamber via said inlet nozzle, and an output duct;

a fan arranged relative to said outlet of said enclosed chamber, and arranged to force haze out of said output duct;

a conduit in fluid communication with, and fixedly attached to, said output duct of said enclosed haze chamber;

a bubble wand fixedly attached at an end of said conduit, distal from said output duct, said bubble wand including a through opening extending to an outwardly pointing front face of said bubble wand;

a source of bubble fluid in communication with said through opening and configured to provide bubble fluid through said opening and to said outwardly pointing front face of said bubble wand;

a body of said bubble wand including a through passage configured to channel haze from said conduit to said bubble fluid at said outwardly pointing front face of said bubble wand to produce haze-filled bubbles.

2. The haze-filled bubble device of claim 1, wherein the haze source includes a heater for vaporizing fluid pumped to said heater from a fluid container.

3. The haze-filled bubble device of claim 1, wherein said source of bubble fluid includes a pump for providing bubble fluid from a bubble fluid reservoir.

4. The haze-filled bubble device of claim 1, further comprising a wiper configured to cyclically pass across said outwardly pointing front face of said bubble wand, said wiper being configured to spread said bubble fluid from said opening across said outwardly pointing front face of said bubble wand to form a meniscus of bubble fluid across said outwardly pointing front face of said bubble wand.

5. The haze-filled bubble device of claim 4, wherein said wiper includes a wiping arm having a bar, said wiping arm configured to pivot about a pivot point and wipe said bubble fluid across said outwardly pointing front face with said bar.

6. The haze-filled bubble device of claim 5, further comprising a motor driven crank arm engaged with a cam slot of said wiping arm and configured to cyclically pivot said wiping arm between an up position and a down position.

7. The haze-filled bubble device of claim 6, further comprising a switch that activates said pump, said wiping arm configured to close said switch and activate said pump when said wiping arm is in said down position.

8. The haze-filled bubble device of claim 1, further comprising a lift fan provided in front of and below said bubble wand, said lift fan arranged at an angle relative to a floor of said device, and configured to blow air at said angle to lift bubbles produced from said bubble wand.

9. The haze-filled bubble device of claim 1, further comprising a processor configured to receive control signals from an external device and control the production of bubbles based on those control signals.

10. The haze-filled bubble device of claim 1, wherein said fan is arranged inside said enclosed chamber adjacent to said output duct.

11. A method of producing bubbles, comprising the steps of:

providing a haze-filled bubble device according to claim 1;

cyclically providing bubble fluid from the bubble fluid source to an outwardly pointing front face of the bubble wand; and forcing a stream of haze through the bubble wand and the bubble fluid at said outwardly pointing front face to create a stream of bubbles.

12. The method of claim 11, wherein the haze-filled bubble device includes a wiper configured to cyclically pass across the outwardly pointing front face of the bubble wand, and wherein the cyclically providing step includes wiping the bubble fluid across the outwardly pointing front face of the bubble wand with the wiping arm to form a meniscus over the outwardly pointing front face of the bubble wand.

13. A bubble device, comprising:

a conduit;

a fan adjacent to said conduit and arranged to force a stream of air through said conduit;

a bubble wand arranged at an end of said conduit, distal from said fan, said bubble wand including a through opening extending from said conduit to an outwardly pointing front face of said bubble wand;

a source of bubble fluid in communication with said through opening and configured to provide bubble fluid through said opening and to said outwardly pointing front face of said bubble wand;

a wiper configured to cyclically pass across said outwardly pointing front face of said bubble wand, said wiper being configured to spread said bubble fluid from said opening across said outwardly pointing front face of said bubble wand to form a meniscus of bubble fluid across said outwardly pointing front face of said bubble wand;

a body of said bubble wand including a through passage in fluid communication with said conduit and configured to channel air from said conduit to said meniscus to produce bubbles.

14. The bubble device of claim 13, wherein said source of bubble fluid includes a pump for providing bubble fluid from a bubble fluid reservoir.

15. The bubble device of claim 14, wherein said wiper includes a wiping arm having a bar, said wiping arm configured to pivot about a pivot point and wipe said bubble fluid across said outwardly pointing front face with said bar.

16. The bubble device of claim 15, further comprising a motor driven crank arm engaged with a cam slot of said wiping arm and configured to cyclically pivot said wiping arm between an up position and a down position.

17. The bubble device of claim 16, further comprising a switch that activates said pump, said wiping arm configured to close said switch and activate said pump when said wiping arm is in said down position.

18. The bubble device of claim 13, further comprising a lift fan provided in front of and below said bubble wand, said lift fan arranged at an angle relative to a floor of said device, and configured to blow air at said angle to lift bubbles produced from said bubble wand.

19. The bubble device of claim 13, further comprising a processor configured to receive control signals from an external device and control the production of bubbles based on those control signals.

20. A method of producing bubbles, comprising the steps of:

providing a bubble device according to claim 13;

cyclically providing bubble fluid from the bubble fluid source to an outwardly pointing front face of the bubble wand and wiping the bubble fluid across the outwardly pointing front face of the bubble wand with the wiping arm to form a meniscus over the outwardly pointing front face of the bubble wand; and forcing air through the bubble wand to the meniscus to create a stream of bubbles.

21. The method of claim 20, further comprising the step of:

generating haze; and wherein said forcing step includes forcing haze with said air through the bubble wand to the meniscus and wherein the bubbles created are haze-filled bubbles.

* * * * *